US007973479B2

(12) United States Patent
Tsuda et al.

(10) Patent No.: US 7,973,479 B2
(45) Date of Patent: Jul. 5, 2011

(54) DISCHARGE LAMP

(75) Inventors: Toshiaki Tsuda, Shizuoka (JP); Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 223 days.

(21) Appl. No.: 12/327,850

(22) Filed: Dec. 4, 2008

(65) Prior Publication Data

US 2009/0146546 A1 Jun. 11, 2009

(30) Foreign Application Priority Data

Dec. 6, 2007 (JP) ..... 2007-315544

(51) Int. Cl.
*H01J 17/16* (2006.01)
*H01J 61/30* (2006.01)

(52) U.S. Cl. ..... 313/634; 313/623; 313/625; 313/25; 313/318.12

(58) Field of Classification Search ..... None
See application file for complete search history.

(56) References Cited

U.S. PATENT DOCUMENTS

| | | | | |
|---|---|---|---|---|
| 7,642,721 | B2 * | 1/2010 | Nagahara et al. | 313/631 |
| 2007/0159104 | A1 * | 7/2007 | Kanazawa et al. | 313/634 |
| 2008/0007178 | A1 * | 1/2008 | Utsubo et al. | 313/634 |
| 2009/0134762 | A1 * | 5/2009 | Serita et al. | 313/113 |
| 2009/0206753 | A1 * | 8/2009 | Kakisaka | 313/634 |
| 2009/0316410 | A1 * | 12/2009 | Takeda et al. | 362/263 |

FOREIGN PATENT DOCUMENTS

JP 2004-103461 A 4/2004

* cited by examiner

*Primary Examiner* — Ashok Patel
(74) *Attorney, Agent, or Firm* — Sughrue Mion, PLLC

(57) ABSTRACT

A discharge lamp for a vehicle is provided with a ceramic luminous tube, a front side electrode and a rear side electrode held by the ceramic luminous tube, a first lead wire connected to the front side electrode, a second lead wire connected to the rear side electrode, a third lead wire having a front end portion connected to the first lead wire, an outer tube, and a socket. The ceramic luminous tube, the first lead wire, the second lead wire and the third lead wire are accommodated in the outer tube. The ceramic luminous tube includes a luminous portion and a pair of small diameter tube portions. The luminous portion is formed into a substantially cylindrical shape extending in a longitudinal direction. The third lead wire includes a horizontal portion extending in the longitudinal direction above the luminous portion.

5 Claims, 4 Drawing Sheets

| NO. | DISTANCE L (mm) | CHARACTERISTIC OF LIGHT DISTRIBUTION (lux) | STARTING VOLTAGE (kV) |
|---|---|---|---|
| 1 | 0.0 | 7.8 | *11.5 |
| 2 | 0.3 | 10.0 | *12.7 |
| 3 | 0.4 | 11.3 | *13.2 |
| 4 | 0.5 | *12.2 | *13.8 |
| 5 | 0.7 | *13.5 | *14.7 |
| 6 | 1.0 | *15.0 | *15.5 |
| 7 | 1.5 | *15.7 | *16.7 |
| 8 | 1.8 | *16.0 | *17.5 |
| 9 | 2.0 | *16.2 | *18.0 |
| 10 | 2.5 | *16.6 | 20.3 |
| 11 | 2.8 | *16.8 | 20.7 |
| 12 | 3.5 | *17.5 | 20.5 |

DISCHARGE LAMP

BACKGROUND OF THE INVENTION

1. Field of the Invention

The present invention relates to a discharge lamp for a vehicle. More particularly, the present invention relates to a discharge lamp for preventing a generation of dazzling light when a lead wire connected to an electrode is arranged in an outer tube. The present invention also relates to a downsizing of a discharge lamp for a vehicle.

2. Background

In a vehicle headlight, for example, an incandescent lamp (incandescent bulb) or a halogen lamp (halogen bulb) is used for a light source. Alternatively, a discharge lamp (discharge bulb) is used for the light source.

In a headlight in which an incandescent lamp or a halogen lamp is used as the light source, a filament of the incandescent lamp or the halogen lamp is substantially uniformly luminous and formed into a rod-shaped luminous portion. Accordingly, when the incandescent lamp or the halogen lamp is used for a reflection type lighting device in which a reflector is used, it is easy to execute a light distribution control by a shape of a reflecting face of the reflector. Using the incandescent lamp or the halogen lamp as the light source has the above advantages.

On the other hand, when a vehicle headlight, in which a discharge lamp is used as the light source, the following advantages are provided. Since a quantity of light of the discharge lamp is larger than that of the incandescent lamp or the halogen lamp, it is possible to enhance a luminance. In addition, a life of the discharge lamp is longer than that of the incandescent lamp or the halogen lamp.

As described above, the luminance of the discharge lamp is higher than that of the incandescent lamp or the halogen lamp and the life of the discharge lamp is longer than that of the incandescent lamp or the halogen lamp, the vehicle headlight having the discharge lamp has recently come into wide use.

There is a discharge lamp including a luminous tube made of transparent quartz glass in which a pair of electrodes are held and rare gas is filled. However, the luminous tube made of quartz glass is corroded by metallic halide filled in the luminous tube. Accordingly, the blackening and the devitrification are caused in the last stage of its life and it becomes impossible to obtain a proper light distribution and the luminance is lowered.

Therefore, in JP-A-2004-103461, it is proposed to use a ceramic luminous tube made of a transmission type ceramics having a high heat resistance property not corroded by metallic halide, in the discharge lamp, instead of the above glass luminous tube.

In the discharge lamp described in JP-A-2004-103461, a pair of electrodes are held by the ceramic luminous tube and respectively connected to the first and the second lead wire. A portion of the first lead wire and a portion of the second lead wire are respectively joined to and sealed by both end portions of the ceramic luminous tube. Therefore, an airtightly closed space is formed in the ceramic luminous tube. The airtightly closed space formed in the ceramic luminous tube is filled with gas such as rare gas and metallic halide. The ceramic luminous tube is covered with an outer tube made of glass.

The first lead wire positioned on the front side is protruded to the front from the outer tube. The third lead wire is connected to a front end portion of the first lead wire. The third lead wire is formed out of a horizontal portion extending in the horizontal direction and a vertical portion extending upward from a front end portion of the horizontal portion. The vertical portion is connected to a front end portion of the first lead wire. The horizontal portion of the third lead wire is attached with an insulating sleeve.

A rear end portion of the horizontal portion the third lead wire is connected to a socket. A end portion of the second lead wire located on the rear side is also connected to the socket.

In the discharge lamp composed as described above, the socket is attached to the reflector and arranged in a lighting device space formed by a lamp housing and a cover. In the discharge lamp, when voltage is impressed upon a pair of electrodes, a discharge is executed in the luminous portion and light emits from the luminous portion. The emitting light is reflected on the reflection face of the reflector and irradiated to the front of a vehicle.

However, in the conventional discharge lamp described in JP-A-2004-103461, since the third lead wire is arranged outside the outer tube, the light emitting from the luminous portion to the third lead wire side and the light emitting from the luminous portion and reflected on the reflection face of the reflector reach a horizontal portion (insulating sleeve) of the third lead wire and become dazzling light (glare light) being reflected by the third lead wire in a direction not intended.

In addition, because the third lead wire is arranged outside the outer tube, it is necessary to provide a connecting portion of the socket with the horizontal portion of the third lead wire at a corresponding position outside the outer tube. Accordingly, dimensions of the socket are increased. When the dimensions of the socket are increased, under the condition that the discharge lamp is attached to the reflector, an area occupied by the socket with respect to the shape of the reflector is increased. Accordingly, the reflecting face of the reflector is reduced corresponding to the increase in the area occupied by the socket and it becomes impossible to effectively utilize the light emitting from the discharge lamp.

SUMMARY OF THE INVENTION

One or more embodiments of the invention provide a discharge lamp in which a dazzling light is prevented from generating and a downsizing is achieved.

In accordance with one or more embodiments of the invention, a discharge lamp for a vehicle is provided with a ceramic luminous tube made of ceramic; a front side electrode and a rear side electrode held by the ceramic luminous tube and separately arranged in front and rear sides; a first lead wire connected to the front side electrode and located in the front side of the front side electrode; a second lead wire connected to the rear side electrode and located in the rear side of the rear side electrode; a third lead wire having a front end portion connected to the first lead wire; an outer tube that is made of glass and covers and accommodates the ceramic luminous tube, the first lead wire, the second lead wire and the third lead wire; and a socket having a first connection terminal to which a rear end portion of the second lead wire is connected and also having a second connection terminal to which a rear end portion of the third lead wire is connected. In the discharge lamp, the ceramic luminous tube includes a luminous portion and a pair of small diameter tube portions, outer diameters of the small diameter tube portions are smaller than an outer diameter of the luminous portion, and the small diameter tube portions are respectively continued to both end portions in a longitudinal direction of the luminous portion. The luminous portion is formed into a substantially cylindrical shape extending in the longitudinal direction. The third lead wire includes a horizontal portion extending in the longitudinal direction above the luminous portion.

Accordingly, in the discharge lamp, the lead wire is arranged in the outer tube together with the ceramic luminous tube.

Therefore, the light emitting from the luminous portion of the ceramic luminous tube is seldom reflected by the third lead wire in a direction not intended. As a result, the generation of dazzling light (glare light) can be prevented.

In addition, it becomes possible to arrange the third lead wire at a position close to the ceramic luminous tube within the outer tube. Accordingly, the discharge light can be downsized and an area occupied by the socket can be reduced. Therefore, the light emitting from the luminous portion can be effectively utilized.

In the discharge lamp, the outer tube may be formed into a shape extending in the longitudinal direction, and a central axis extending in the longitudinal direction of the luminous portion may be offset from a central axis extending in the longitudinal direction of the outer tube. Moreover, the central axis of the luminous portion may position below the central axis of the outer tube.

When the central axis of the luminous portion is positioned below the central axis of the outer tube, it is possible to prevent a formation of the secondary light source on the lower side of the luminous portion when light is emitted from the luminous portion. Accordingly, the generation of dazzling light can be prevented.

The discharge lamp may further be provided with an insulating sleeve attached to the horizontal portion of the third lead wire, and the insulating sleeve may arranged at least in a portion on the rear side of the luminous portion except for a portion right above the luminous portion. According to this configuration, the generation of a discharge phenomenon between the third lead wire and the second lead wire can be prevented.

In the discharge lamp, a distance between the horizontal portion of the third lead wire and the luminous portion of the ceramic luminous tube may be set at a value not less than 0.5 mm and not more than 2.0 mm. According to this configuration, by the electric field action of the third lead wire, a discharge executed in the luminous portion can be facilitated. Therefore, a starting voltage at the time of turning on the discharge lamp can be lowered.

In the discharge lamp, the outer tube may include a blockade portion for covering the ceramic luminous tube and a holding portion (19*b*) integrated with the blockade portion and protruding from a front end of the blockade portion, and a front end portion of the first lead wire may be embedded in the holding portion and held by the holding portion. According to this configuration, the first lead wire is not exposed into an outside of the outer tube, so that the first lead wire can be prevented from being oxidized.

Other aspects and advantages of the invention will be apparent from the following description, the drawings and the claims.

BRIEF DESCRIPTION OF THE DRAWINGS

FIG. 1 is a view showing an outline of the vehicle headlight.

FIG. 3 is also a view showing the characteristic of light distribution and the measurement region, at a lower portion of FIG. 3.

DETAILED DESCRIPTION OF THE EXEMPLARY EMBODIMENTS

An exemplary embodiment of the invention will be explained below. A discharge lamp for a vehicle is provided in a vehicle headlight.

Headlights 1, 1 for a vehicle are respectively attached to both end portions on the right and left at a front end portion of the vehicle.

Figure 1:
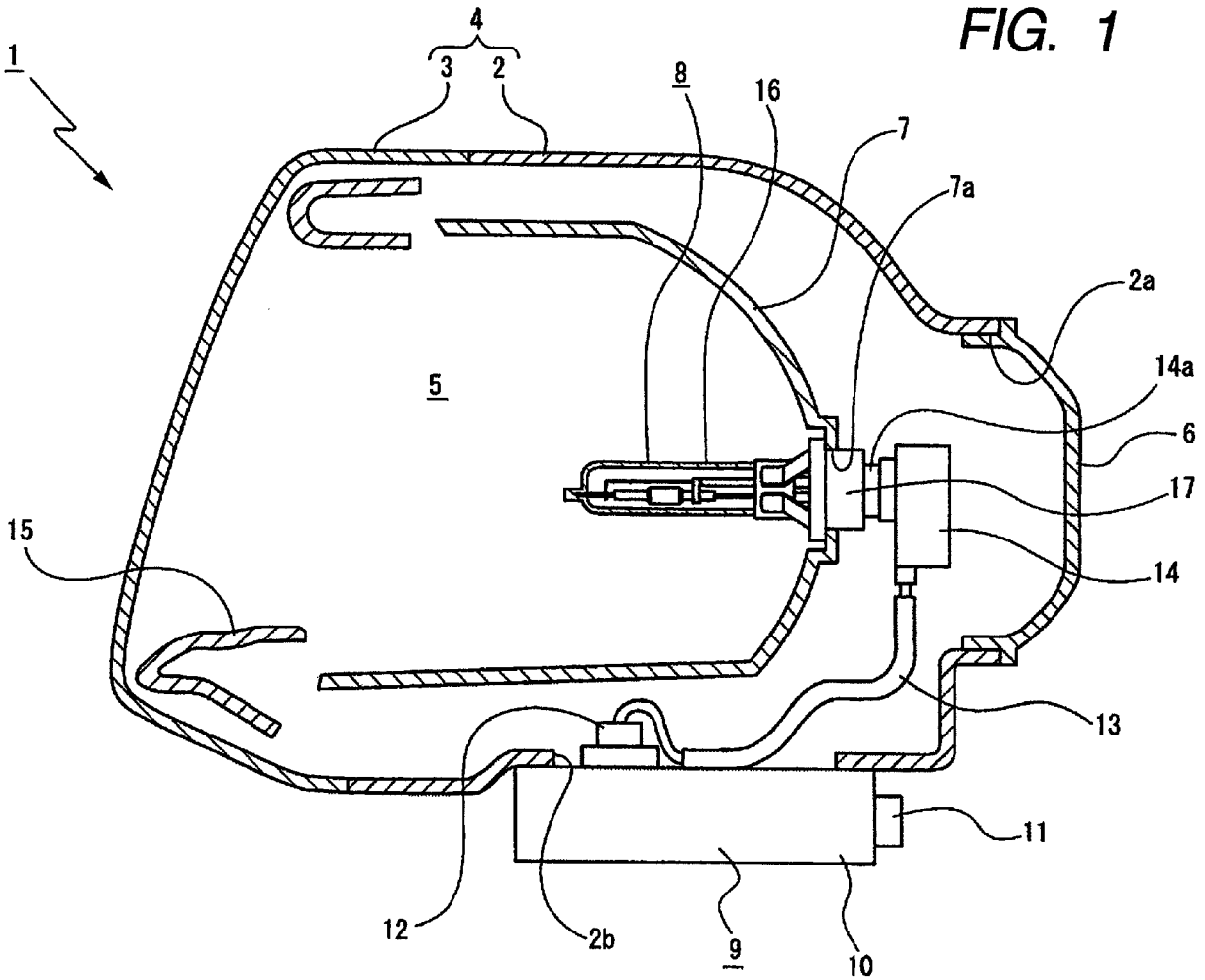
FIG. 1 shows a discharge lamp according to an exemplary embodiment of the invention, together with FIGS. 2 to 4.

As shown in FIG. 1, each headlight 1 for a vehicle includes: a lamp housing 2 having a recess portion open to the front; and a cover 3 for closing an opening face of the lamp housing 2. The lamp housing 2 and the cover 3 compose a lighting device outer housing 4. An inner space of the lighting device outer housing 4 is formed into a lighting chamber 5.

The insertion hole 2*a* penetrating in a longitudinal direction is formed at a rear end portion of the lamp housing 2. The insertion hole 2*a* is closed by the back cover 6. At a lower end portion of the lamp housing 2, the arrangement hole 2*b* penetrating in the vertical direction is formed.

In the lighting chamber 5, a reflector 7 is supported by an optical axis adjusting mechanism not shown being capable of tilting. The reflector 7 is made of, for example, resin material. At a rear end portion of the reflector 7, the attaching hole 7*a* penetrating in the longitudinal direction is formed.

The discharge lamp 8 is attached to an attaching hole 7*a* of the reflector 7.

A discharge lamp lighting device 9 is attached to the arranging hole 2*b* of the lamp housing 2. A lighting circuit not shown is accommodated in the case body 10 of the discharge lamp lighting device 9. On an outer circumferential face of the case body 10, an input side connector 11 is provided. On an upper face of the case body 10, an output side connector 12 is provided. The input side connector 11 is connected to an electric power supply circuit not shown.

The output side connector 12 is connected to the starting device 14 through a feeder cord 13. The connector 14*a* of the starting device 14 is connected to the socket described later of the discharge lamp 8.

The discharge lamp 8 is turned on as follows. Voltage of the electric power supply circuit is boosted up by the lighting circuit of the discharge lamp lighting device 9. At the same time, the voltage is converted from DC to AC so as to obtain a lighting voltage which is a high AC voltage. The thus obtained lighting voltage is impressed upon the discharge lamp 8 through the feeder cord 13 and the starting device 14. In this way, the discharge lamp 8 is turned on.

In the lighting chamber 5, an extension 15 is arranged for shielding a part of each component arranged in the lighting chamber 5. In the lighting chamber 5, a shade not shown for shading a portion of light, which emits from the discharge lamp 8, is arranged.

The discharge lamp 8 is composed when the body 16 is connected to the socket 17. Concerning this matter, refer to FIG. 2.

The body 16 includes: a ceramic luminous tube 18; and an outer tube 19 for covering the ceramic luminous tube 18.

The ceramic luminous tube 18 is made of ceramics. In the ceramic luminous tube 18, the luminous portion 20 and small diameter tube portions 21, 21, which are respectively connected to both end portions in the front and at the rear of the luminous portion 20, are integrated with each other into one body. The luminous portion 20 and the small diameter tube portions 21, 21 are respectively formed into substantially cylindrical shapes extending in the longitudinal direction. An outer diameter of the small diameter tube portion 21, 21 is smaller than that of the luminous portion 20.

In the luminous portion 20, metallic halide and rare gas such as xenon or argon are filled.

In general, the ceramic luminous tube is stable with respect to metallic halide. Therefore, the ceramic luminous tube is advantageous in that the life is longer than that of the glass luminous tube. The heat resistance property of the ceramic luminous tube is higher than that of the glass luminous tube and the degree of freedom of forming of the ceramic luminous tube is advantageously high.

The front side electrode 22 and the rear side electrode 23, which are respectively formed to be long in the longitudinal direction, are arranged in the small diameter tube portions 21, 21.

The first lead wire 24 extending in the longitudinal direction is connected to a front end portion of the front side electrode 22. The first lead wire 24 is protruded to the front from the small diameter tube portion 21 on the front side of the ceramic luminous tube 18.

The second lead wire 25 extending in the longitudinal direction is connected to a rear end portion of the rear side electrode 23. The second lead wire 25 is protruded backward from the small diameter tube portion 21 on the rear side of the ceramic luminous tube 18. A rear end portion of the second lead wire 25 is connected to the first connection terminal not shown provided in the socket 17.

A rear end portion of the first lead wire 24 and a front end portion of the second lead wire 25 are respectively joined to the small diameter portions 21, 21 by frit glass not shown inside the small diameter portions 21, 21 of the ceramic luminous tube 18. When the first lead wire 24 and the second lead wire 25 are respectively joined to the small diameter portions 21, 21 by frit glass, an airtightly closed space is formed in the ceramic luminous tube 18.

The outer tube 19 is composed in such a manner that the blockade portion 19*a* for covering the ceramic luminous tube 18 and the holding portion 19*b* protruding to the front from the front end portion of the blockade portion 19*a* are integrated with each other into one body by quartz glass. A front end portion of the first lead wire 24 is held by the holding portion 19*b* being embedded. Thereby, the first lead wire 24 is not exposed into an outside of the outer tube 19, so that the first lead wire 24 can be prevented from being oxidized. A space formed in the outer tube 19 is an accommodating space 26.

In the accommodating space 26, the third lead wire 27 is arranged together with the ceramic luminous tube 18, the first lead wire 24 and the second lead wire 25. Accordingly, the ceramic luminous tube 18, the first lead wire 24, the second lead wire 25 and the third lead wire 27 are covered with the outer tube 19.

The third lead wire 27 includes: a horizontal portion 27*a* extending in the longitudinal direction; and a vertical portion 27*b* bent at a front end portion of the horizontal portion 27*a* and extended in the vertical direction.

The horizontal portion 27*a* of the third lead wire 27 is arranged above the ceramic luminous tube 18. The rear end portion of the third lead wire 27 is connected to the second connection terminal not shown provided in the socket 17. Distance L (shown in FIG. 2) between the horizontal portion 27*a* and the luminous portion 20 of the ceramic luminous tube 18 is set at a value, for example, not less than 0.5 mm and not more than 2.0 mm.

Figure 3:
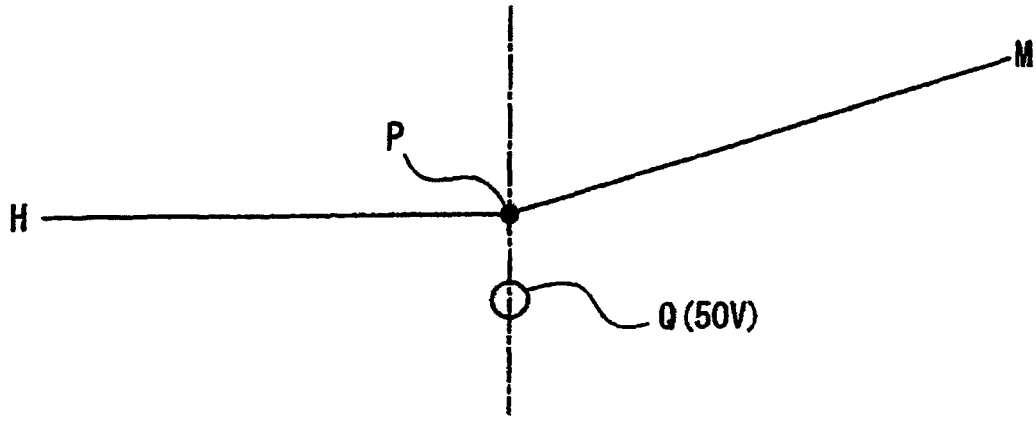
FIG. 3 is a table showing a measurement result of the characteristic of light distribution and the starting voltage with respect to the distance between the horizontal portion of the third lead wire and the luminous portion of the ceramic luminous tube, at an upper portion of FIG. 3.

FIG. 3 is a table showing a result of the measurement of the relation among the distance L, the characteristic of light distribution and the starting voltage. FIG. 3 shows a result of the measurement in which the characteristic of light distribution and the starting voltage are measured at the time of changing the distance L. The characteristic of light distribution is measured at the point Q in the neighborhood of the continuous point P, which is a point where the horizontal cut line H and the oblique cut line M continue to each other as shown in a lower drawing of FIG. 3, according to the standard shown in ECE Standard No. 98. The characteristic of light distribution shows data of the luminance measured at the point Q when the drive voltage 13.5 V is impressed. The starting voltage is data showing the maximum value when the discharge lamp is subjected to a cold start and a hot start (the rest time: 1 second to 3 minutes).

Concerning the characteristic of light distribution, it is desirable that the luminance is not less than 12 lux so that the discharge lamp can be used as a vehicle headlight. Concerning the starting voltage, from the viewpoint of reducing voltage of the discharge lamp for a vehicle, it is desirable that the starting voltage is not more than 20 kV. The target value was set in such a manner that the luminance is not less than 12 lux and the starting voltage is not more than 20 kV.

As shown in FIG. 3, target values were obtained in the objects Nos. 4 to 9 to be measured. Data that attained the target value is attached with the mark * in FIG. 3.

As shown in FIG. 3, when the distance L was not less than 0.5 mm and not more than 2.0 mm, it was possible to obtain an excellent result in which the luminance was not less than 12 lux and the starting voltage was not more than 20 kV. As described above, when the distance L between the horizontal portion 27*a* of the third lead wire 27 and the luminous portion 20 of the ceramic luminous tube 18 was set at a value not less than 0.5 mm and not more than 2.0 mm, it was possible to ensure the characteristic of light distribution of the discharge lamp 8 for a vehicle and it was possible to reduce the starting voltage.

A portion on the rear end side of the horizontal portion 27*a* of the third lead wire 27 is attached with the insulating sleeve 28. The insulating sleeve 28 is made of insulating material such as glass or ceramics. A front end of the insulating sleeve 28 is located in the front side of the rear end of the small diameter portion 21 on the rear side of the ceramic luminous tube 18. Accordingly, a portion of the insulating sleeve 28 and a portion of the small diameter portion 21 on the rear side of the ceramic luminous tube 18 are located being overlapped with each other in the vertical direction. Concerning this matter, refer to the reference mark W in FIG. 2.

In the discharge lamp 8, in the accommodating space 26, the portion on the rear end side of the horizontal portion 27*a* of the third lead wire 27 and the second lead wire 25 are positioned on the upper and lower sides. However, as described above, since the insulating sleeve 28 is attached to a portion on the rear end side of the horizontal portion 27*a*, it is possible to prevent the generation of a discharge phenomenon between the third lead wire 27 and the second lead wire 25.

Since a portion of the insulating sleeve 28 and a portion of the small diameter portion 21 on the rear side of the ceramic luminous tube 18 are located being overlapped with each other in the vertical direction, it is possible to positively prevent the generation of discharge phenomenon between the third lead wire 27 and the second lead wire 25.

The horizontal portion 27*a* of the third lead wire 27 and the small diameter tube portion 21 on the rear side of the ceramic luminous tube 18 are combined with each other by the band member 29. The band member 29 is made of material, the hear resistance property of which is high. An upper end portion of the band member 29 is located right before the insulating sleeve 28.

When the third lead wire 27 and the small diameter tube portion 21 of the ceramic luminous tube 18 are combined with each other by the band member 29, the third lead wire 27 can be stably held in the accommodating space 26 and the positional accuracy between the horizontal portion 27*a* of the third lead wire 27 and the luminous portion 20 of the ceramic luminous tube 18 can be enhanced.

Figure 2:
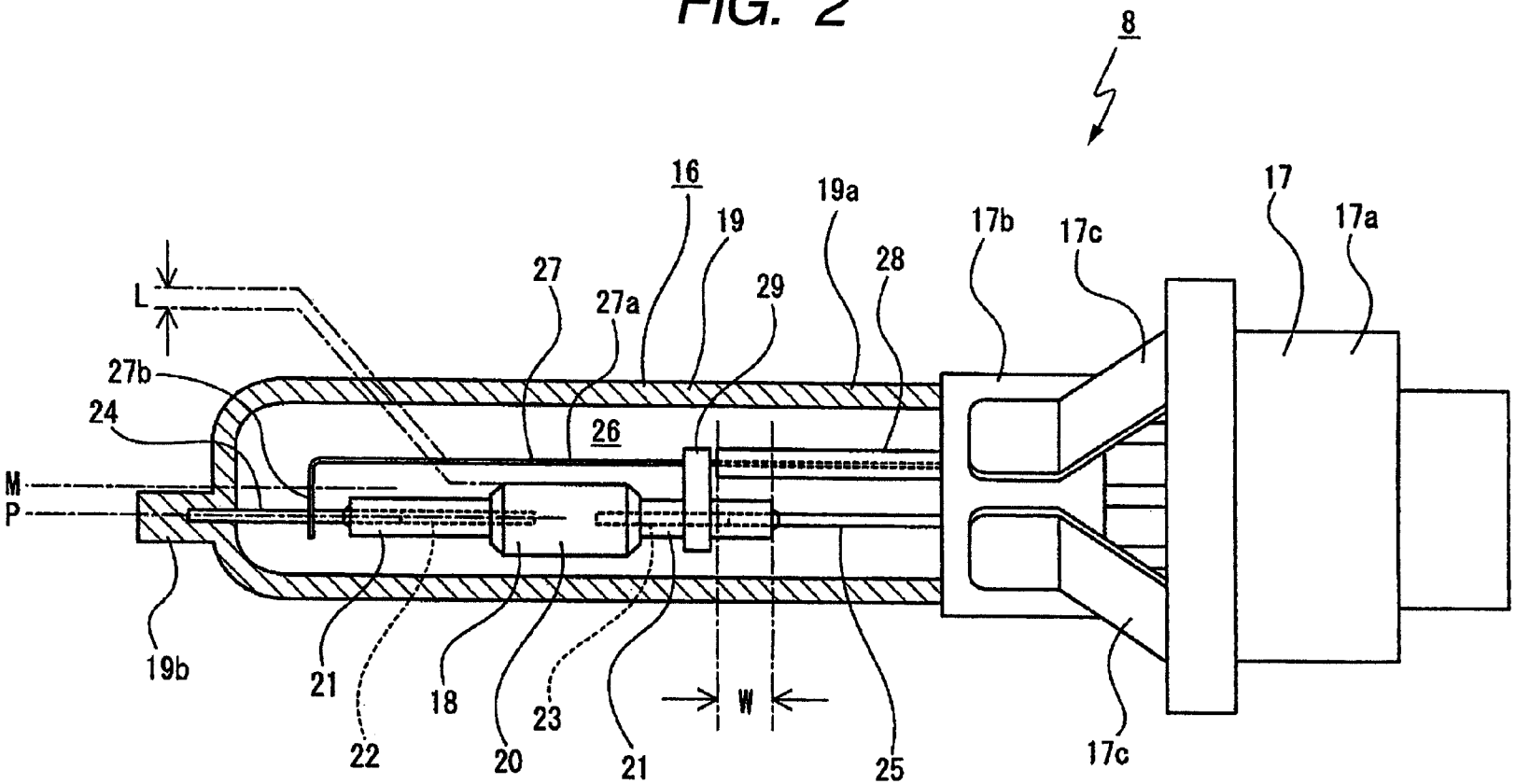
FIG. 2 is an enlarged side view in which a portion of the discharge lamp is shown in a sectional view.

In the discharge lamp 8, the central axis P of the luminous portion 20 of the ceramic luminous tube 18 is located at a position lower than the central axis M of the outer tube 19 as shown in FIG. 2. A distance between the central axis P and the central axis M is set at a value, for example, not less than 0.1 mm and not more than 2.0 mm.

In the discharge lamp 8, a portion of the light emitting from the luminous portion is reflected on an inner face of the outer tube made of glass and a secondary light source is formed on the lower side of the luminous portion in some cases. There is a possibility that the light emitting from the secondary light source formed on the lower side becomes dazzling light (glare light) with respect to an opponent car when it is irradiated upward.

However, in the discharge lamp 8, as described above, the central axis P of the luminous portion 20 of the ceramic luminous tube 18 is located at a position lower than the central axis M of the outer tube 19. Accordingly, the secondary light source is seldom formed on the lower side of the luminous portion 20 and the generation of dazzling light can be suppressed.

The socket 17 includes: an attached portion 17*a* to be attached to the reflector 7; and a holding portion 17*b* for holding the outer tube 19. The holding portion 17*b* is connected to the attached portion 17*a* by a plurality of connecting legs 17*c*, 17*c*, . . . protruding to the front from the attached portion 17*a*.

The socket 17 is attached to the reflector 7 when a portion of the attached portion 17*a* is inserted into the attaching hole 7*a* of the reflector 7 from the front side as shown in FIG. 1.

As described above, in the discharge lamp 8, the third lead wire 27 is accommodated in the accommodating space 26 formed in the outer tube 19 and arranged above the ceramic luminous tube 18. Accordingly, the light emitting from the luminous portion 20 of the ceramic luminous tube 18 and the light emitting from the luminous portion 20 and reflected on a reflecting face of the reflector 7 are seldom reflected by the third lead wire 27 in a direction not intended. Therefore, the generation of dazzling light (glare light) can be prevented.

When the third lead wire 27 is arranged in the outer tube 19, the body 16 of the discharge lamp 8 and the socket 17 can be downsized. Accordingly, an area occupied by the socket 17 is reduced with respect to the dimensions of the reflector 7. Therefore, an area of the reflecting face of the reflector can be increased and the light emitting from the luminous portion 20 can be effectively utilized.

Further, since the third lead wire 27 is accommodated in the outer tube 19, at the time of assembling the discharge lamp 8 to the reflector 7, there is no possibility that a finger or a jig for assembling is contacted with the third lead wire 27. Accordingly, it is possible to prevent the discharge lamp 8 from being damaged at the time of assembling the discharge lamp 8 to the reflector 7.

Figure 4:
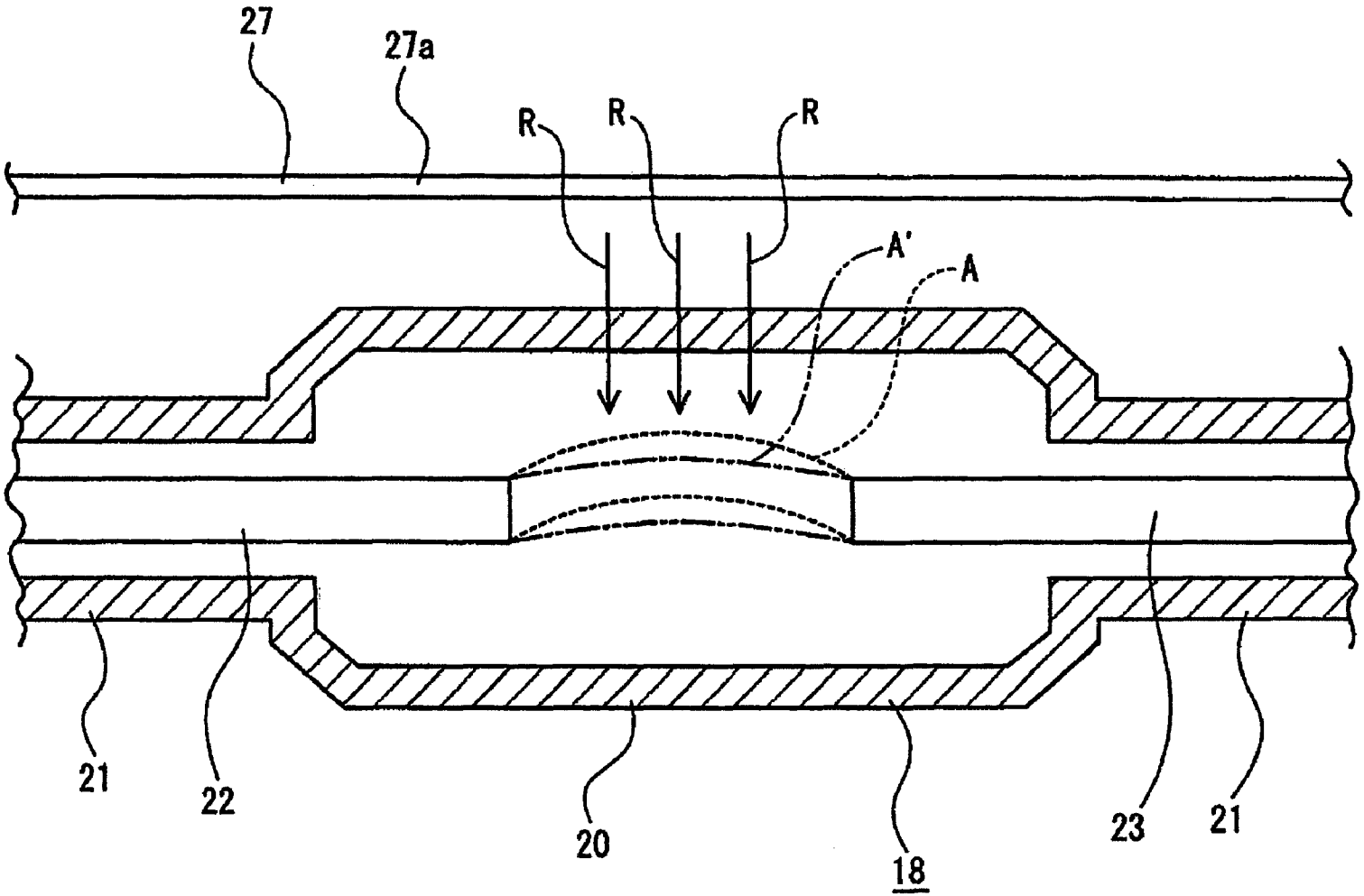
FIG. 4 is a conceptual view for explaining an effect of suppressing an arc bend.

In this connection, in general, as shown in FIG. 4, when a discharge is executed in the discharge lamp, a so-called arc bend is caused in which the arc A generated between a pair of electrodes at the time of discharging is bent so that a central portion of the arc A is displaced upward. This state is shown by the dotted-line in FIG. 4. This bend of the arc could be a cause of the deterioration of the characteristic of light distribution and it also could be a cause of cracks in the luminous portion generated when an internal temperature of the luminous portion is not uniform.

However, in the discharge lamp 8, the third lead wire 27 is arranged close to the luminous portion 20 above the luminous portion 20. Therefore, by the Lorentz force R, R, . . . , it is possible to suppress the generation of the arc bend as shown by the two-dotted chain line in FIG. 4.

Accordingly, in the discharge lamp 8, the characteristic of light distribution can be enhanced. Further, the internal temperature of the luminous portion 20 can be made uniform, so that the generation of cracks in the luminous portion 20 can be prevented.

In the discharge lamp 8, when a discharge is executed in the luminous portion 20 of the ceramic luminous tube 18, the discharge executed in the luminous portion 20 is facilitated by an electric field action of the third lead wire 27. Accordingly, when the third lead wire 27 is arranged in the outer tube 19, the starting voltage at the time of turning on the discharge lamp 8 can be reduced.

Further, in the discharge lamp 8, the horizontal portion 27*a* of the third lead wire 27 is arranged along the luminous portion 20. Therefore, when heat is emitted from the ceramic luminous tube 18, radiation heat to the luminous portion 20 is generated in the third lead wire 27. Especially, at the time of turning off the discharge light 8, a heat insulating effect with respect to the luminous portion 20 is generated and a cooling speed of the ceramic luminous tube 18 is suppressed and the occurrence of a sudden cooling is prevented. Therefore, it is possible to prevent the generation of cracks of the ceramic luminous tube 18 at the time of turning off the light.

In the discharge lamp 8, the luminous portion 20 of the ceramic luminous tube 18 is formed into a substantially annular shape extending in the longitudinal direction and the horizontal portion 27*a* of the third lead wire 27 is arranged being extended in the longitudinal direction along an outer circumferential face of the luminous portion 20. Accordingly, a distance between the horizontal portion 27*a* of the third lead wire 27 and the outer circumferential face of the luminous portion 20 is constant. Therefore, the entire luminous portion 20 can be uniformly heat-insulated.

In addition to that, in the discharge lamp 8, the accommodating space 26, which is an inner space of the outer tube 19, can be made vacuum. When the accommodating space 26 is made vacuum, no convection is generated in the accommodating space 26 or only a small convection is generated. Accordingly, when heat is emitted from the ceramic luminous tube 18, the heat insulating property of the luminous portion 20 can be more enhanced by the radiation heat generated by the outer tube 19.

While description has been made in connection with specific embodiments and modified examples of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF REFERENCE NUMERALS AND SIGNS

8 . . . Discharge lamp
17 . . . Socket
18 . . . Ceramic luminous tube
19 . . . Outer tube
20 . . . Luminous portion
21 . . . Small diameter tube portion
22 . . . Front side electrode
23 . . . Rear side electrode
24 . . . First lead wire
25 . . . Second lead wire
27 . . . Third lead wire
27*a* . . . Horizontal portion
28 . . . Insulation sleeve

What is claimed is:

1. A discharge lamp for a vehicle comprising:

a ceramic luminous tube made of ceramic;

a front side electrode and a rear side electrode held by the ceramic luminous tube and separately arranged in a front and rear direction;

a first lead wire connected to the front side electrode and located in a front side of the front side electrode;

a second lead wire connected to the rear side electrode and located in a rear side of the rear side electrode;

a third lead wire having a front end portion connected to the first lead wire;

an outer tube that is made of glass and covers and accommodates the ceramic luminous tube, the first lead wire, the second lead wire and the third lead wire; and a socket having a first connection terminal to which a rear end portion of the second lead wire is connected and also having a second connection terminal to which a rear end portion of the third lead wire is connected, wherein the ceramic luminous tube includes a luminous portion and a pair of small diameter tube portions, outer diameters of the small diameter tube portions are smaller than an outer diameter of the luminous portion, and the small diameter tube portions are respectively continued to both end portions of the luminous portion in the front and rear direction, wherein the luminous portion is formed into a substantially cylindrical shape extending in the front and rear direction, wherein the third lead wire includes a horizontal portion extending in the front and rear direction above the luminous portion, wherein the outer tube is formed into a shape extending in the front and rear direction, and wherein a central axis extending in the front and rear direction of the luminous portion is offset from a central axis extending in the front and rear direction of the outer tube.

2. The discharge lamp according to claim 1, wherein the central axis of the luminous portion is positioned below the central axis of the outer tube.

3. The discharge lamp according to claim 1, wherein the outer tube includes a blockade portion for covering the ceramic luminous tube and a holding portion integrated with the blockade portion and protruding from a front end of the blockade portion, and wherein a front end portion of the first lead wire is embedded in the holding portion and held by the holding portion.

4. A discharge lamp for a vehicle comprising:

a ceramic luminous tube made of ceramic;

a front side electrode and a rear side electrode held by the ceramic luminous tube and separately arranged in a front and rear direction;

a first lead wire connected to the front side electrode and located in a front side of the front side electrode;

a second lead wire connected to the rear side electrode and located in a rear side of the rear side electrode;

a third lead wire having a front end portion connected to the first lead wire;

an outer tube that is made of glass and covers and accommodates the ceramic luminous tube, the first lead wire, the second lead wire and the third lead wire;

a socket having a first connection terminal to which a rear end portion of the second lead wire is connected and also having a second connection terminal to which a rear end portion of the third lead wire is connected, and an insulating sleeve attached to the horizontal portion of the third lead wire, wherein the insulating sleeve is arranged at least in a portion on the rear side of the luminous portion except for a portion right above the luminous portion, wherein the ceramic luminous tube includes a luminous portion and a pair of small diameter tube portions, outer diameters of the small diameter tube portions are smaller than an outer diameter of the luminous portion, and the small diameter tube portions are respectively continued to both end portions of the luminous portion in the front and rear direction, wherein the luminous portion is formed into a substantially cylindrical shape extending in the front and rear direction, and wherein the third lead wire includes a horizontal portion extending in the front and rear direction above the luminous portion.

5. A discharge lamp for a vehicle comprising:

a ceramic luminous tube made of ceramic;

a front side electrode and a rear side electrode held by the ceramic luminous tube and separately arranged in a front and rear direction;

a first lead wire connected to the front side electrode and located in a front side of the front side electrode;

a second lead wire connected to the rear side electrode and located in a rear side of the rear side electrode;

a third lead wire having a front end portion connected to the first lead wire;

an outer tube that is made of glass and covers and accommodates the ceramic luminous tube, the first lead wire, the second lead wire and the third lead wire; and a socket having a first connection terminal to which a rear end portion of the second lead wire is connected and also having a second connection terminal to which a rear end portion of the third lead wire is connected, wherein the ceramic luminous tube includes a luminous portion and a pair of small diameter tube portions, outer diameters of the small diameter tube portions are smaller than an outer diameter of the luminous portion, and the small diameter tube portions are respectively continued to both end portions of the luminous portion in the front and rear direction, wherein the luminous portion is formed into a substantially cylindrical shape extending in the front and rear direction, and wherein the third lead wire includes a horizontal portion extending in the front and rear direction above the luminous portion, and wherein a distance between the horizontal portion of the third lead wire and the luminous portion of the ceramic luminous tube is set at a value not less than 0.5 mm and not more than 2.0 mm.

* * * * *